US011260674B2

(12) United States Patent
Kawai

(10) Patent No.: US 11,260,674 B2
(45) Date of Patent: Mar. 1, 2022

(54) IMAGE FORMING APPARATUS

(71) Applicant: KYOCERA Document Solutions Inc., Osaka (JP)

(72) Inventor: Hisaji Kawai, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 226 days.

(21) Appl. No.: 16/779,089

(22) Filed: Jan. 31, 2020

(65) Prior Publication Data

US 2020/0254782 A1 Aug. 13, 2020

(30) Foreign Application Priority Data

Feb. 8, 2019 (JP) ..... JP2019-021266

(51) Int. Cl.

| | |
|---|---|
| ***B41J 3/60*** | (2006.01) |
| ***B41J 13/00*** | (2006.01) |
| ***B41J 11/00*** | (2006.01) |
| ***B65H 7/14*** | (2006.01) |
| ***B41J 11/46*** | (2006.01) |

(52) U.S. Cl.

CPC ..... *B41J 3/60* (2013.01); *B41J 11/0095* (2013.01); *B41J 11/46* (2013.01); *B41J 13/0045* (2013.01); *B65H 7/14* (2013.01); *B65H 2511/242* (2013.01); *B65H 2701/1315* (2013.01)

(58) Field of Classification Search

CPC . B41J 3/60; B41J 11/0095; B41J 11/46; B41J 13/0045; B65H 7/14; B65H 2511/242; B65H 2701/1315

See application file for complete search history.

(56) References Cited

U.S. PATENT DOCUMENTS

| | | | | |
|---|---|---|---|---|
| 2014/0306395 | A1* | 10/2014 | Suzuki | B41J 11/46 270/18 |
| 2015/0036156 | A1* | 2/2015 | Kondo | G06K 15/4065 358/1.12 |
| 2016/0221778 | A1 | 8/2016 | Ueda et al. | |
| 2018/0170699 | A1* | 6/2018 | Yamasaki | B41J 11/0095 |

FOREIGN PATENT DOCUMENTS

| | | | |
|---|---|---|---|
| JP | 2016-145814 | A | 8/2016 |
| JP | 2018-94850 | A | 6/2018 |

* cited by examiner

*Primary Examiner* — Henok D Legesse

(74) *Attorney, Agent, or Firm* — Stein IP, LLC

(57) ABSTRACT

An image forming apparatus includes a sheet conveyance portion, a recording portion, a sheet detection portion, and a control portion. In a duplex printing including a first and a second process of printing on a first surface and a second surface of the sheet, in the first process, the control portion calculates a center position of the sheet based on an edge position of the sheet on one side in the width direction and size information of the sheet, prints a first image on the first surface such that the first image is centered on the center position calculated, and prints a reference marker on the first surface. In the second process, the control portion calculates a correction magnification ratio based on a difference between a reading position and the printing position of the reference marker, and corrects a size and a printing position of a second image.

7 Claims, 8 Drawing Sheets

IMAGE FORMING APPARATUS

INCORPORATION BY REFERENCE

This application is based upon and claims the benefit of priority from the corresponding Japanese Patent Application No. 2019-21266 filed on Feb. 8, 2019, the entire contents of which are incorporated herein by reference.

BACKGROUND

The present disclosure relates to recording apparatuses such as facsimile machines, copiers, printers, etc., and in particular, relates to image forming apparatuses which perform printing by ejecting ink through ink ejection nozzles provided in a recording head.

Recording apparatuses such as facsimile machines, copiers, printers, etc. are configured to print an image on a sheet-shaped recording medium such as a paper sheet, a cloth sheet, an OHP sheet, etc., and can be classified, in terms of the printing method used therein, into inkjet recording apparatuses, wire-dot recording apparatuses, thermal recording apparatuses, etc. Inkjet recording apparatuses can be further classified into serial type inkjet recording apparatuses, which perform printing with a recording head scanning a recording medium, and line head type inkjet recording apparatuses, which perform printing with a recording head fixed to the apparatus main body.

When printing is performed on recording media using a recording apparatus, if the recording media deviate from each other in a direction (the width direction thereof) orthogonal to the recording-medium conveyance direction, printing positions on the recoding media also deviate from each other. To prevent this, for example, in a case where the recording media are to be bound together after printing, high printing-positional precision is required in the printing of each page. In particular, in a case where an inkjet recording apparatus is used, ink is likely to penetrate into a recording medium to cause show-through, and thus, still higher printing-positional precision is required in duplex printing.

To meet this requirement, in a conventional image forming apparatus, on a conveyance belt on which a sheet is conveyed, a contact image sensor (CIS) is arranged to detect the position of an edge of the sheet in its width direction. In this image forming apparatus, the CIS detects the position of an edge of the sheet in its width direction based on the difference in intensity of received light resulting from the presence or absence of the sheet.

For example, there is known an edge detection device which binarizes output values of a CIS arranged in a conveyance path for conveying conveyed objects (sheets), and which, when a position at which the resulting binarized values change is within an edge detection range stored one for each size of the conveyed object, judges that the position is the position of an edge of the conveyed object. Further, there is also known a technique of shifting a conveyed object in its width direction based on an amount of deviation of a detected edge position from a reference position.

There is also known an inkjet recording apparatus which calculates the center position of a recording medium based on the positions of opposite edges of the recording medium in its width direction detected by an edge-position detection sensor, and which shifts an ink-nozzle-used region based on the difference between the calculated center position and a reference center position. Further, there is also known a technique of, when one edge position of a recording medium in its width direction is located outside an effective detection region of an edge-position detection sensor, shifting an ink-nozzle-used region based on the difference between the other edge position of the recording medium in its width direction and a reference edge position determined based on the size information of the recording medium.

SUMMARY

According to one aspect of the present disclosure, an image forming apparatus includes a sheet conveyance portion, a recording portion, a sheet detection portion, and a control portion. The sheet conveyance portion conveys a sheet. The recording portion is arranged facing the sheet conveyance portion, and ejects ink to a printing surface of the sheet conveyed by the sheet conveyance portion. The sheet detection portion is arranged on an upstream side of the recording portion with respect to a sheet conveyance direction, is capable of reading a reading surface of the sheet opposite to the printing surface, and detects an edge position of the sheet on one side of the sheet in a width direction intersecting the sheet conveyance direction. The control portion controls ink ejection from the recording portion and prints an image on the printing surface of the sheet. In a duplex printing including a first process of printing a first image on a first surface of the sheet as the printing surface and a second process of printing a second image on a second surface of the sheet as the printing surface, in the first process, the control portion calculates a center position of the sheet based on the edge position of the sheet on the one side of the sheet in the width direction thereof having been detected by the sheet detection portion and size information of the sheet having been obtained in advance, prints the first image on the first surface such that the first image is centered on the center position calculated, and prints a reference marker at a predetermined printing position on the first surface. In the second process, the control portion reads the reference marker by means of the sheet detection portion, calculates a correction magnification ratio based on a difference between a reading position of the reference marker having been read and the printing position of the reference marker, and corrects a size of the second image and a printing position of the second image in the width direction using the correction magnification ratio.

Still other objects of the present disclosure and specific advantages provided by the present disclosure will become further apparent from the following descriptions of embodiments.

DETAILED DESCRIPTION

Figure 1:
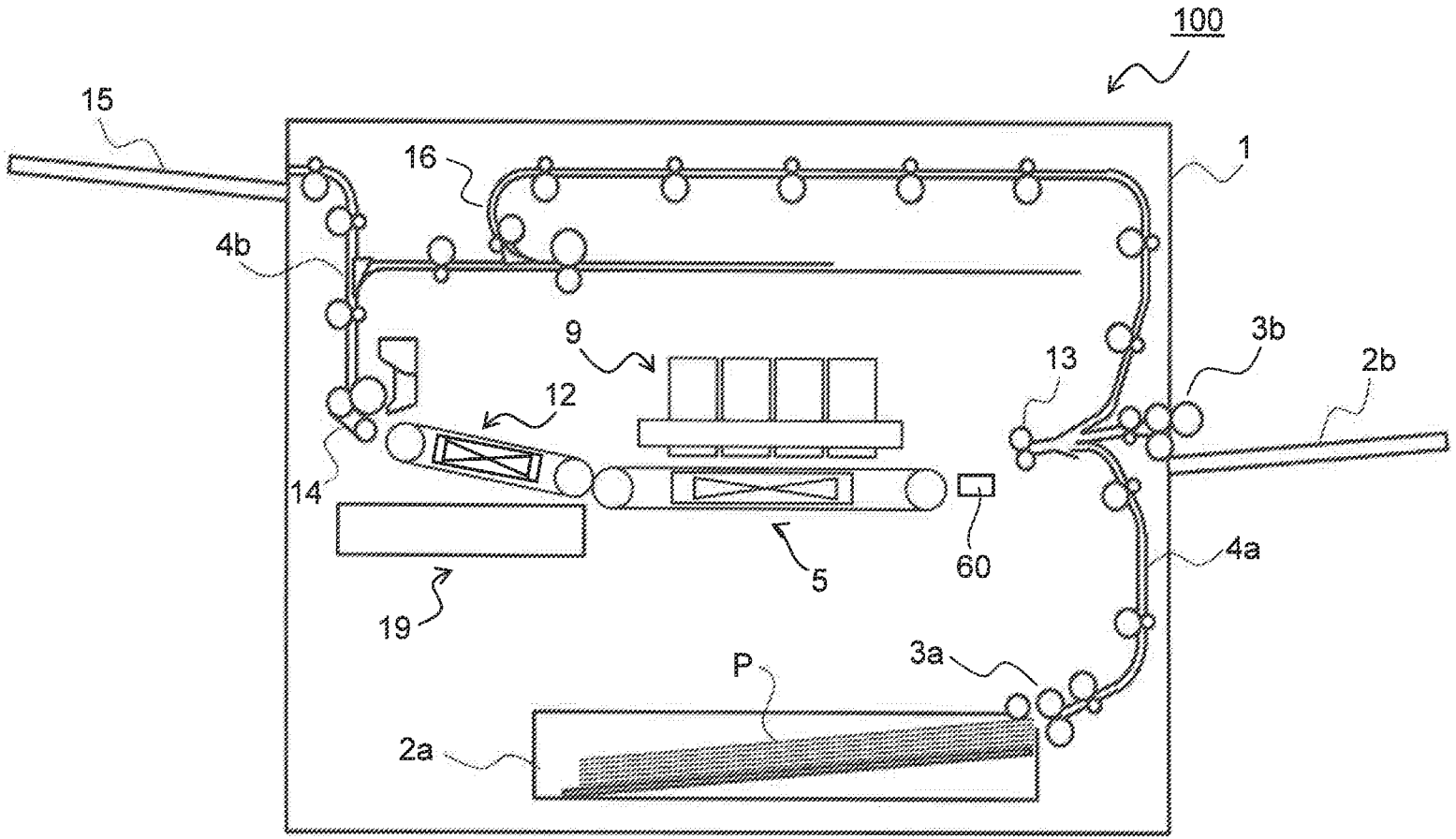
FIG. 1 is a side sectional view showing an outline of a structure of a printer according to an embodiment of the present disclosure.
Figure 2:
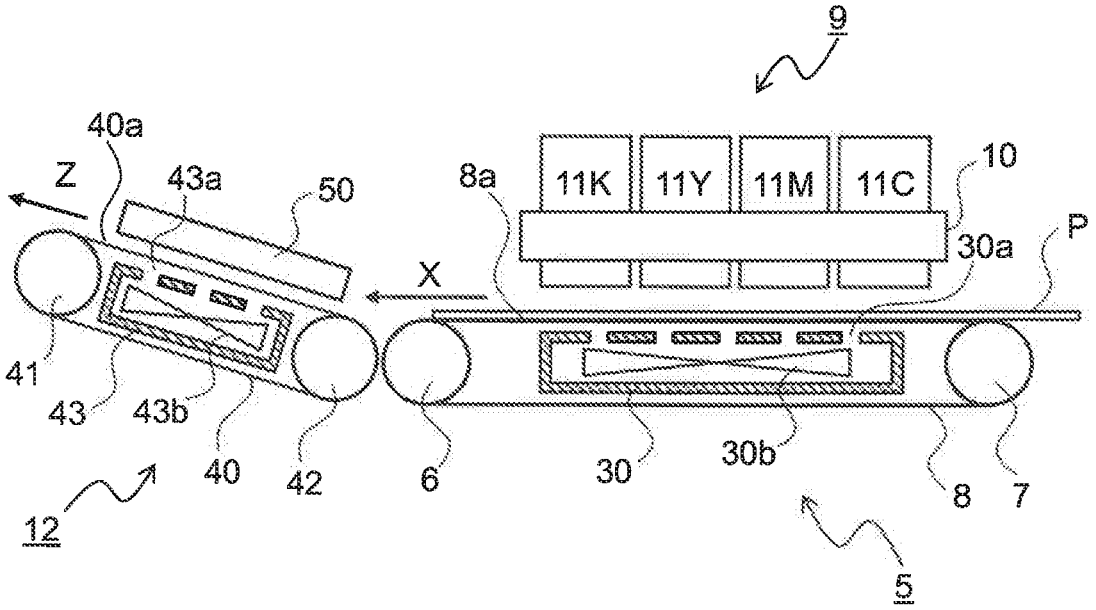
FIG. 2 is a side sectional view showing a structure of an area around a first belt conveyance portion, a recording portion, and a second belt conveyance portion of the printer of the present embodiment.
Figure 3:
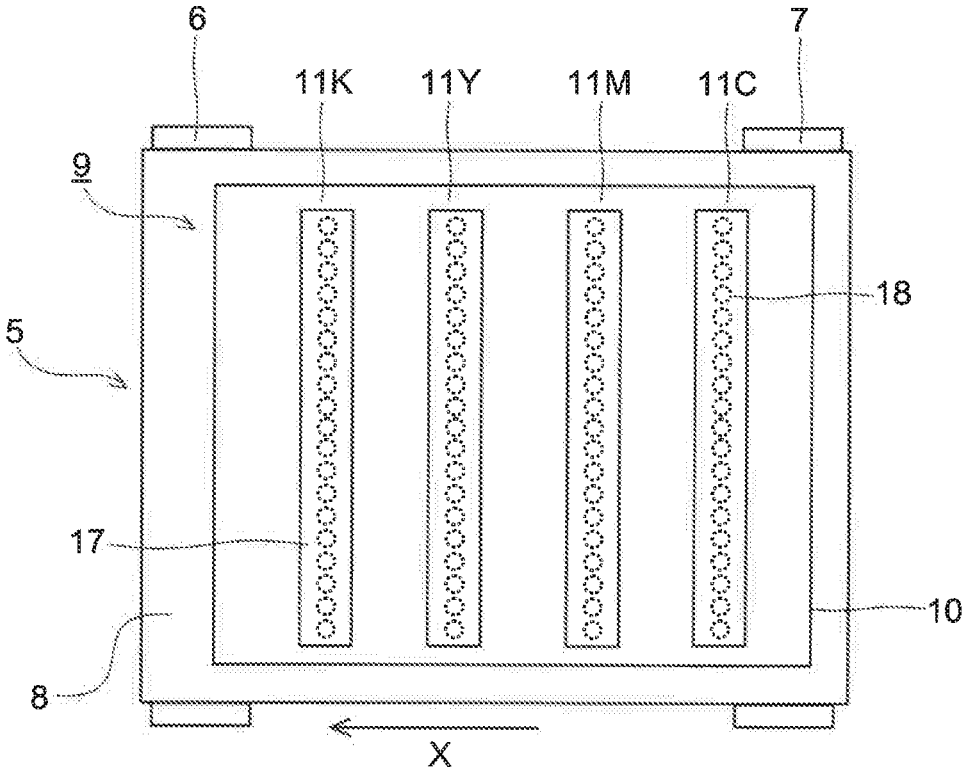
FIG. 3 is a plan view of the first belt conveyance portion and the recording portion of the printer of the present embodiment as seen from above.

Hereinafter, embodiments of the present disclosure will be described with reference to the accompanying drawings. FIG. 1 is a diagram showing an outline of a structure of a printer 100, which is of an inkjet recording type, according to an embodiment of the present disclosure, FIG. 2 is a sectional view showing a structure of an area around a first belt conveyance portion 5, a recording portion 9, and a second belt conveyance portion 12 of the printer 100 shown in FIG. 1, and FIG. 3 is a plan view of the first belt conveyance portion 5 and the recording portion 9 of the printer 100 shown in FIG. 1 as seen from above.

As shown in FIG. 1, the printer 100 includes a sheet feed cassette 2*a* which is arranged, as a sheet storage portion, in a lower part inside a printer main body 1, and a manual sheet feed tray 2*b* which is provided outside the right side face of the printer main body 1. On a downstream side of the sheet feed cassette 2*a* in a sheet conveyance direction, that is, above the right side of the sheet feed cassette 2*a* in FIG. 1, a sheet feed device 3*a* is arranged. Further, on a downstream side of the manual sheet feed tray 2*b* in the sheet conveyance direction, that is, on the left side of the manual sheet feed tray 2*b* in FIG. 1, a sheet feed device 3*b* is arranged. The sheet feed devices 3*a* and 3*b* feed out sheets P separately one by one.

Inside the printer 100, a first sheet conveyance passage 4*a* is provided. The first sheet conveyance passage 4*a* is located to the upper right of the sheet feed cassette 2*a* and is located to the left of the manual sheet feed tray 2*b*. A sheet P fed out of the sheet feed cassette 2*a* is conveyed vertically upward along a side face of the printer main body 1 through the first sheet conveyance passage 4*a*. A sheet P fed out of the manual sheet feed tray 2*b* is conveyed approximately horizontally leftward through the first sheet conveyance passage 4*a*.

At a downstream end of the first sheet conveyance passage 4*a* with respect to the sheet conveyance direction, a registration roller pair 13 is provided. Furthermore, near the registration roller pair 13 on its downstream side, a first belt conveyance portion (a sheet conveyance portion) 5 and a recording portion 9 are arranged. The registration roller pair 13 on one hand corrects skewed feeding of a sheet P, and on the other hand feeds out the sheet P toward the first belt conveyance portion 5 with timing coordinated with ink ejection operation executed by the recording portion 9.

Between the registration roller pair 13 and the first belt conveyance portion 5, a CIS (Contact Image Sensor) 60 is provided as a sheet detection portion for detecting the position of an edge of the sheet P in its width direction (a direction perpendicular to the sheet conveyance direction). The structure of the CIS 60 will be described in detail later.

The first belt conveyance portion 5 includes a first conveyance belt 8 (see FIG. 2), which is an endless belt wound around a first drive roller 6 and a first driven roller 7. A sheet P fed out of the registration roller pair 13 passes under the recording portion 9 in a state of being held by suction on a conveyance surface 8*a* of the first conveyance belt 8.

Inside the first conveyance belt 8, at a portion facing a back side of the conveyance surface 8*a* of the first conveyance belt 8, there is provided a first sheet-suction portion 30. The first sheet-suction portion 30 has a large number of holes 30*a* provided in its upper surface for air to be sucked therethrough. The first sheet-suction portion 30 has a fan 30*b* provided inside thereof to suck air downward through its upper surface. The first conveyance belt 8 also has a large number of air holes 8*b* formed therein (see FIG. 5) for air to be sucked therethrough. With this configuration, the first belt conveyance portion 5 conveys a sheet P while holding the sheet P on the conveyance surface 8*a* of the first conveyance belt 8 by suction.

The recording portion 9 includes line heads 10C, 10M, 10Y, and 10K which perform printing of an image on a sheet P conveyed in the state of being held on a conveyance surface 8*a* of the first conveyance belt 8 by suction. In accordance with information of image data received from an external computer or the like, the line heads 10C to 10K sequentially eject their respective ink toward a sheet P sucked on the first conveyance belt 8. Thereby, on the sheet P, a full-color image is printed that has ink of four colors, namely, cyan, magenta, yellow, and black, overlaid together. The printer 100 can print a monochrome image as well.

As shown in FIG. 3, the recording portion 9 is provided with a head housing 10 and line heads 11C, 11M, 11Y, and 11K held in the head housing 10. These line heads 11C to 11K each have a printing region which is wider than a sheet P conveyed, and are supported at a height such that a predetermined gap (for example, 1 mm) is formed between the line heads 11C to 11K and the conveyance surface 8*a* of the first conveyance belt 8. The line heads 11C to 11K have recording heads 17 arranged along the sheet width direction (the up-down direction in FIG. 3) orthogonal to the sheet conveyance direction. The recording heads 17 each have a large number of ink ejection nozzles 18 arranged on their ink ejection surfaces.

The recording heads 17 respectively constituting the line heads 11C to 11K are each supplied with ink of a corresponding one of four colors (cyan, magenta, yellow, and black) respectively stored in ink tanks (not shown).

In accordance with image data received from an external computer or the like, the recording heads 17 eject ink to a sheet P conveyed by being held on the conveyance surface 8*a* of the first conveyance belt 8 by suction from such ones of the ink ejection nozzles 18 as correspond to a printing position. Thereby, on the sheet P held on the first conveyance belt 8, a full-color image is formed that has ink of four colors, namely, cyan, magenta, yellow, and black, overlaid together.

On a downstream side of the first belt conveyance portion 5 with respect to the sheet conveyance direction (the left side in FIG. 1), the second belt conveyance portion 12 is arranged. After having an image printed thereon at the recording portion 9, the sheet P is sent to the second belt conveyance portion 12, and while the sheet P is passing over the second belt conveyance portion 12, the ink having been ejected onto a surface of the sheet P is dried.

The second belt conveyance portion 12 includes a second conveyance belt 40, which is an endless belt wound around a second drive roller 41 and a second driven roller 42. The second conveyance belt 40 is made by the second drive roller 41 to rotate in the counterclockwise direction in FIG. 2. After having an image printed thereon at the recording portion 9, the sheet P is conveyed in the arrow-X direction by the first belt conveyance portion 5 to be delivered to the second conveyance belt 40 to be then conveyed in the arrow-Z direction in FIG. 2.

Inside the second conveyance belt 40, at a position facing a back side of a conveyance surface 40*a* of the second conveyance belt 40, there is provided a second sheet-suction portion 43. The second sheet-suction portion 43 has a large number of holes 43*a* in its upper surface for air to be sucked therethrough. The second sheet-suction portion 43 has a fan 43*b* provided inside thereof to suck air downward from its upper surface. The second conveyance belt 40 also has a large number of air holes (not shown) formed therein for air to be sucked therethough. With this configuration, the second belt conveyance portion 12 conveys a sheet P while holding the sheet P on the conveyance surface 40*a* of the second conveyance belt 40 by suction.

At a position facing the conveyance surface 40*a* of the second conveyance belt 40, a conveyance guide portion 50 is provided. The conveyance guide portion 50 constitutes a sheet conveyance path together with the conveyance surface 40*a* of the second conveyance belt 40, and helps reduce warping and fluttering of a sheet P held on the conveyance surface 40*a* by suction by the second sheet-suction portion 43.

On a downstream side of the second belt conveyance portion 12 with respect to the sheet conveyance direction, at a position near a left side surface of the printer main body 1, a decurler portion 14 is provided. The sheet P, after having the ink thereon dried at the second belt conveyance portion 12, is sent to the decurler portion 14, where curling of the sheet P is corrected.

On a downstream side of (in FIG. 1, above) the decurler portion 14 with respect to the sheet conveyance direction, a second sheet conveyance passage 4*b* is provided. In a case where duplex printing is not performed, a sheet P having passed through the decurler portion 14 is discharged from the second sheet conveyance passage 4*b*, via a discharge roller pair, onto a sheet discharge tray 15 provided outside the left side face of the printer 100. In a case where printing is performed on both surfaces of the sheet P, the sheet P printing on one surface of which has been finished and which has passed through the second belt conveyance portion 12 and the decurler portion 14 passes through the second sheet conveyance passage 4*b* to be then conveyed to a reverse conveyance passage 16. The sheet P having been sent to the reverse conveyance passage 16 has its conveyance direction switched to be turned over, and then the sheet P passes through an upper part of the printer 100 to be conveyed to the registration roller pair 13. Then, the sheet P is conveyed, with its unprinted surface up, back to the first belt conveyance portion 5.

Below the second belt conveyance portion 12, a maintenance unit 19 is arranged. To perform maintenance of the recording heads 17, the maintenance unit 19 moves to under the recording portion 9 to remove ink ejected (purged) from the ink ejection nozzles 18 (see FIG. 3) of the recording heads 17 and collect the removed ink.

Figure 4:
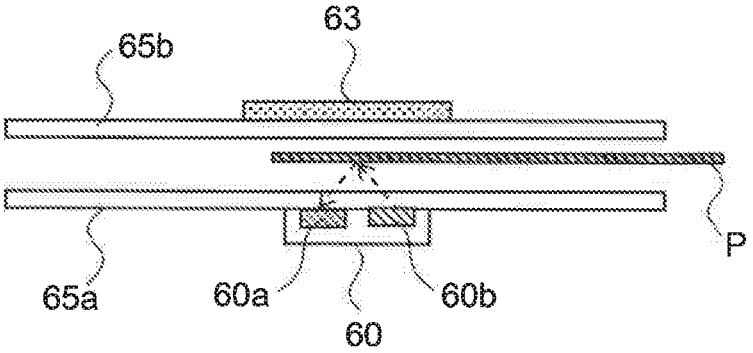
FIG. 4 is a side view of an area around a CIS of the printer of the present embodiment as seen from a direction orthogonal to a sheet conveyance direction.
Figure 5:
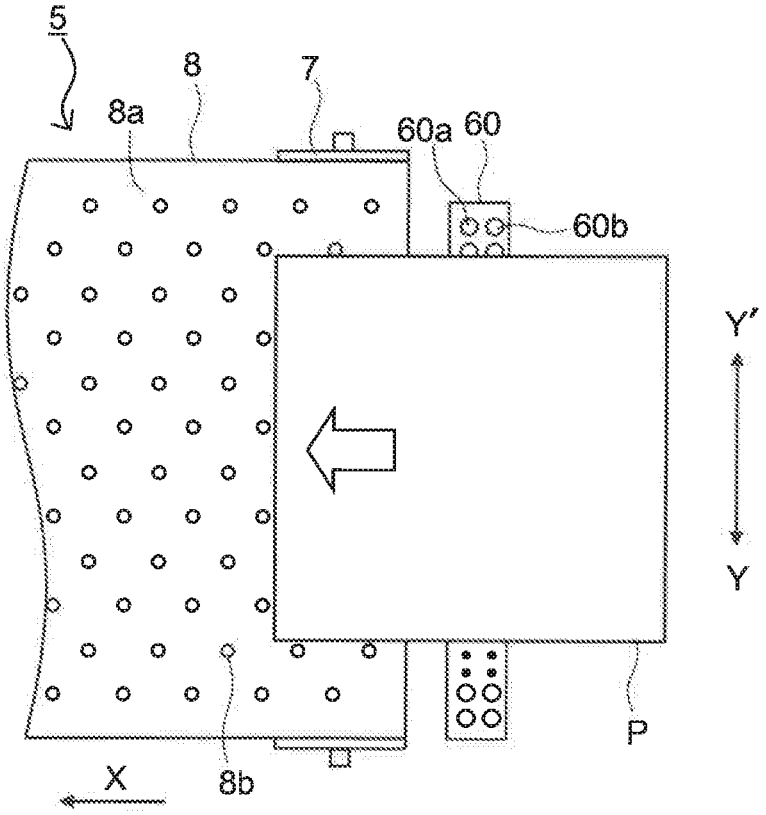
FIG. 5 is a plan view showing a structure of an area around the CIS and the first belt conveyance portion of the printer of the present embodiment.

Next, a structure of the CIS 60 will be described in detail. FIG. 4 is a side view of an area around the CIS 60 of the printer 100 of the present embodiment as seen from a direction orthogonal to the sheet conveyance direction, and FIG. 5 is a plan view showing a structure of an area around the CIS 60 and the first belt conveyance portion 5 of the printer 100 of the present embodiment. The CIS 60 is a reflective CIS, which detects reflection light from a sheet P, and is arranged on an upstream side of the first belt conveyance portion 5 with respect to the sheet conveyance direction.

As shown in FIG. 4, right above the CIS 60, two contact glasses 65*a* and 65*b* are arranged facing each other. An upper surface of the contact glass 65*a* and a lower surface of the contact glass 65*b* form part of the sheet conveyance path (the first sheet conveyance passage 4*a*).

The CIS 60 includes a large number of detection portions 60*a* comprising photoelectric conversion elements and a large number of light emitting portions 60*b* comprising LEDs; the detection portions 60*a* and the light emitting portions 60*b* are arranged parallel to each other along the width direction (the arrow YY' direction in FIG. 5) of the sheet P. The CIS 60 emits light from the light emitting portions 60*b* to the sheet P, and obtains, as image data, reflection light from the sheet P detected by the detection portions 60*a*. Then, based on the thus obtained image data, the CIS 60 detects an edge position of the sheet P in its width direction. In this case, to increase intensity difference between reflection light from the sheet P and reflection light from a sheet non-passing region, it is preferable to arrange a background member 63 having a color different from the color of the sheet P (white) so as to face the detection surface of the CIS 60.

In the CIS 60 adopted in the present embodiment, the region (the effective detection region) where the detection portions 60*a* and the light emitting portions 60*b* are arranged is smaller than the size of a largest usable sheet P in its width direction. As will be described later, the CIS 60 is also capable of reading an image having been formed on the back surface (a reading surface, the lower surface in FIG. 4) of the sheet P.

Figure 6:
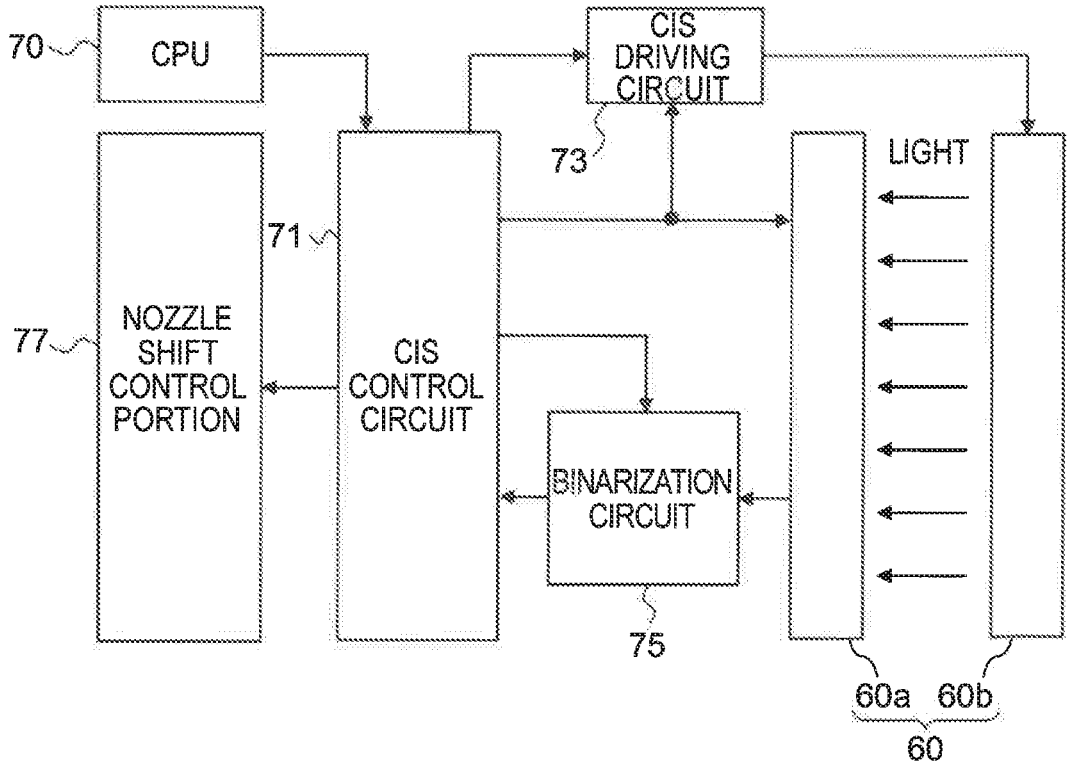
FIG. 6 is a block diagram showing control paths in nozzle-ejection-position correction control performed in the printer of the present embodiment.

FIG. 6 is a block diagram showing control paths in nozzle ejection position correction control performed in the printer 100 of the present embodiment. The overall nozzle ejection position correction control is comprehensively controlled by a CPU (control portion) 70. Here, the CPU 70 may simultaneously perform other controls in the printer 100 as the main CPU of the printer 100, That is, the nozzle ejection position correction control may be implemented as one of the functions of the main CPU of the printer 100, When a printing operation by the printer 100 onto a sheet P is started, the CPU 70 makes various settings, with respect to a CIS control circuit 71, for reading signals from the CIS 60.

The CIS control circuit 71, according to the settings made by the CPU 70, transmits, to the CIS 60, a reference clock signal for reading a signal from the CIS 60 and an accumulation time determination signal for determining the electric charge accumulation time in the CIS 60. The CIS control circuit 71 transmits, to a CIS driving circuit 73, a PWM signal for setting the value of a current to pass in the light emitting portions 60*b* of the CIS 60. The CIS driving circuit 73 generates a direct-current voltage in accordance with the PWM signal fed from the CIS control circuit 71, and uses the generated direct-current voltage as a reference voltage of the current to pass in the light emitting portions 60*b*. The CIS control circuit 71 generates a comparison reference voltage (threshold voltage) for binarizing, in a binarization circuit 75, an analogue signal (a signal outputted) from the CIS 60.

At the timing when a sheet P in a standby state at the registration roller pair 13 (see FIG. 1) is about to be conveyed toward the recording portion 9, the CPU 70 instructs the CIS control circuit 71 to start edge detection. On receiving the instruction from the CPU 70 to start edge detection, the CIS control circuit 71, in synchronization with the accumulation time determination signal, transmits, to the CIS driving circuit 73, a control signal for turning on the light emitting portions 60*b*. The CIS driving circuit 73, according to the control signal from the CIS control circuit 71, turns on the light emitting portions 60*b* for a certain period of time.

In response to the next accumulation time determination signal and reference clock signal, the CIS 60 outputs a voltage equivalent to the amount of light accumulated while the light emitting portions 60*b* are on in each pixel (photoelectric conversion element) in a pixel group of the detection portions 60*a* one pixel at a time as an output signal. The output signal outputted from the CIS 60 is binarized in the binarization circuit 75 by being compared with the comparison reference voltage (threshold voltage) and is fed to the CIS control circuit 71 as a digital signal.

The CIS control circuit 71, for each output signal outputted by the CIS 60, checks whether the value of the digital signal binarized in the binarization circuit 75 is 0 or 1, sequentially one pixel at a time. Then, the CIS control circuit 71 detects the position of the pixel (the position of the photoelectric conversion element) in the detection portions 60*a* at which the value of the digital signal changes from 0 to 1 or from 1 to 0.

When the CIS control circuit 71 detects the position of the pixel at which the value of the digital signal has changed, the position of the pixel is determined to be the edge position of the sheet P in its width direction. The CPU 70 calculates the amount of deviation between the edge position determined by the CIS control circuit 71 and the edge position (the reference edge position) of a case where the sheet P is conveyed at the ideal conveying position (the reference conveying position) where the sheet P passes along the center position of a sheet-passing region. The calculated deviation amount is transmitted to a nozzle shift control portion 77. The nozzle shift control portion 77, according to the transmitted deviation amount of the sheet P in its width direction, shifts the region where the ink ejection nozzles 18 are used in the recording portion 9.

Figure 7:
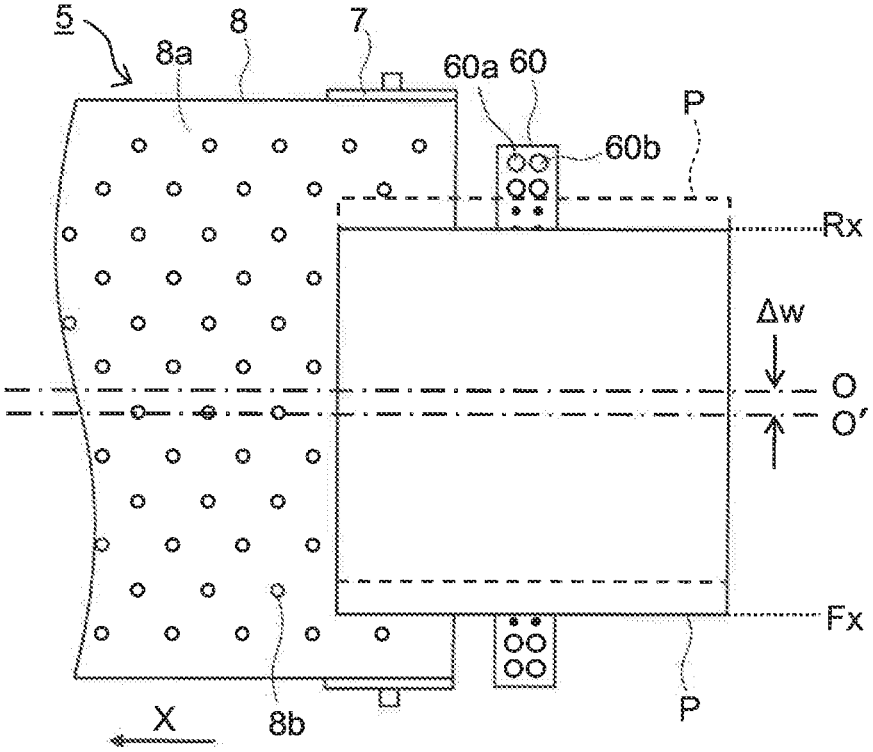
FIG. 7 is a plan view showing a structure of an area around the CIS and the first belt conveyance portion of the printer of the present embodiment, with a sheet deviated toward an apparatus front side.

FIG. 7 is a plan view showing a structure of an area around the CIS 60 and the first belt conveyance portion 5 of the printer 100 of the present embodiment, with a sheet P deviated toward the apparatus front side (downward in FIG. 7). In FIG. 7, let the reference conveyance position be a conveyance position of a case (indicated by short-dash lines in FIG. 7) where the center position of the sheet P in its width direction (the arrow YY' direction in FIG. 7) coincides with the reference center position O of the sheet-passing region.

When the sheet P has deviated by a predetermined amount from the reference conveyance position toward the apparatus front side (indicated by solid lines in FIG. 7), edge positions of the sheet P on the apparatus rear and front sides (upper and lower sides in FIG. 7) also shift to positions Rx and Fx, respectively. Rx and Fx are calculated by detecting, by means of the CIS control circuit 71, positions of pixels at which the digital signals obtained by the binarization circuit 75 binalizing the output signals (analog signals) from the CIS 60 change. Then, the CPU 70 calculates the real center position O' of the sheet P conveyed, and, from the difference between the real center position O' and the reference center position O, the CPU 70 calculates the amount of deviation (=Δw) of the sheet P in its width direction.

Figure 8:
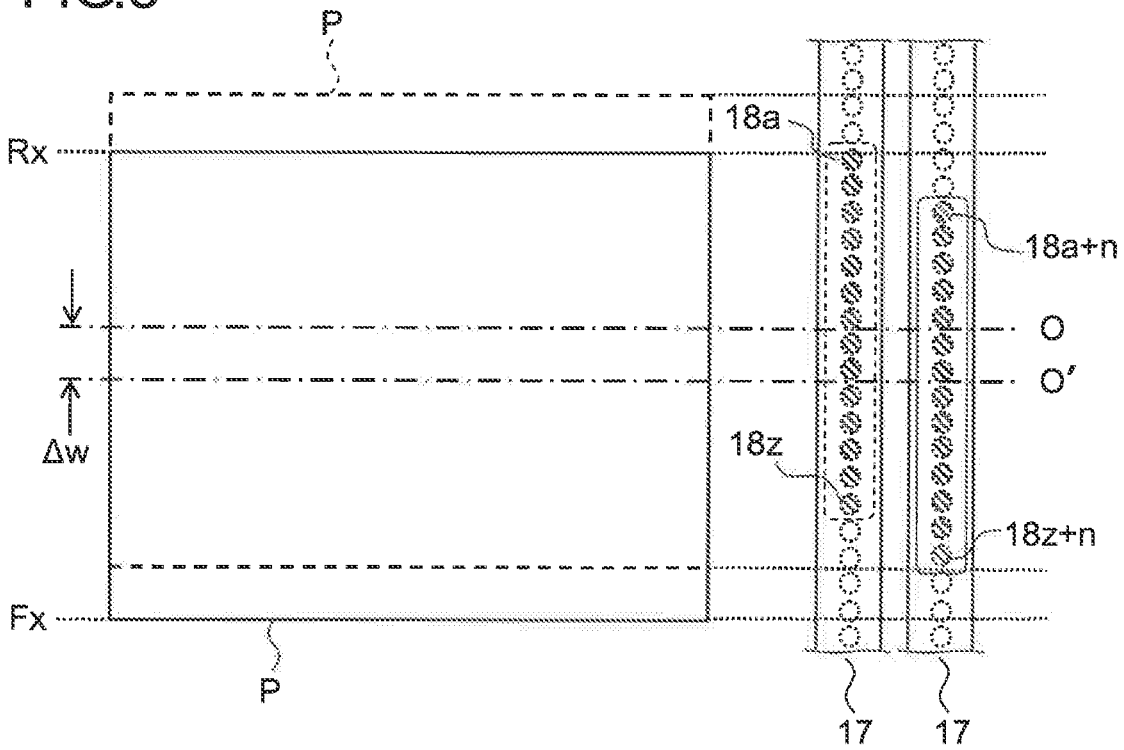
FIG. 8 is a diagram showing a shift of nozzle ejection positions in the printer of the present embodiment, with a sheet deviated toward the apparatus front side.

FIG. 8 is a diagram for illustrating a shift of the nozzle ejection position in a case where the sheet P has deviated toward the apparatus front side as shown in FIG. 7. In a case where the sheet P is conveyed in the reference conveyance position (the position indicated by short-dash lines in FIG. 8), the recording heads 17 each use ink ejection nozzles from the a-th ink ejection nozzle 18*a* to the z-th ink ejection nozzle 18*z* of the ink ejection nozzles 18 to print an image on the sheet P.

If the ink ejection nozzles 18*a* to 18*z* were used to print an image on the sheet P in the case where the sheet P is conveyed in a position (indicated by solid lines in FIG. 8) deviated frontward from the reference conveyance position, the image would be printed at a position biased rearward.

To prevent this, a shift amount for the ink ejection nozzles 18 corresponding to the deviation amount dw of the sheet P in its width direction is determined, and the ink ejection nozzles 18 to be used in the recording heads 17 are shifted. In the example shown in FIG. 8, the deviation amount Δw is equivalent to a number n of nozzles, and hence, ink ejection nozzles from an ink ejection nozzle 18*a+n* to an ink ejection nozzle 18*z+n* are used, the ink ejection nozzle 18*a+n* being located at a position anterior to the ink ejection nozzle 18*a* by the number n of ink ejection nozzles, the ink ejection nozzle 18*z+n* being located at a position anterior to the ink ejection nozzle 18*z* by the number n of ink ejection nozzles.

This enables printing to be performed on the center of the sheet P in the width direction without moving the sheet P in its width direction. Accordingly, the need is eliminated of a mechanism such as a shift roller to shift the position of a sheet P in its width direction, helping to achieve a simple configuration and a simple control of the printer 100.

As described previously, since the edge positions on opposite sides of a sheet P in its width direction are detected, and the deviation amount of the sheet P in its width direction is calculated from the difference between the real center position O' calculated from the detected edge positions and the reference center position O, it is possible to calculate the deviation amount of the sheet P in its width direction without using the size information of the sheet P.

Figure 9:
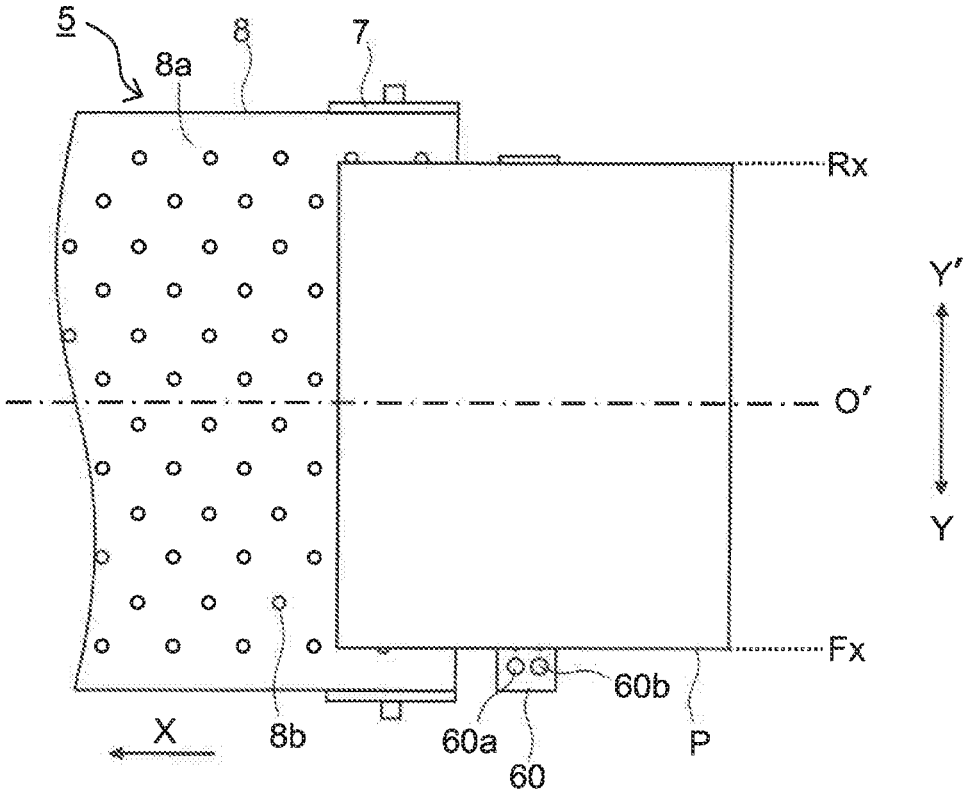
FIG. 9 is a plan view showing a structure of an area around the CIS and the first belt conveyance portion, with a sheet of a maximum acceptable size passing the CIS.

FIG. 9 is a plan view showing a state where a sheet P of the maximum acceptable size is passing the CIS 60. In the state shown in FIG. 9, the edge position Rx of the sheet P on the apparatus rear side cannot be detected, and thus the real center position O' cannot be detected using the edge positions Fx and Rx. In this case, the center position O' of the sheet P is calculated based on the edge position Fx of the sheet P on the apparatus front side and the size information of the sheet P.

Thus, even in a case where one of the edge positions of a sheet P in its width direction is located outside the effective detection region of the CIS 60, it is possible to calculate the center position O' of the sheet P from the other edge position and the size information of the sheet P. Then, from the difference between the thus calculated center position O' and the reference center position O, the deviation amount of the sheet P in its width direction is calculated and the ink ejection nozzles 18 (see FIG. 8) to be used in the recording heads 17 are shifted. The size information of the sheet P is transmitted to the CPU 70 from a sheet size detection sensor (not shown) arranged at the sheet feed cassette 2*a* or the manual sheet feed tray 2*b*, or from an external device such as a personal computer.

In a case where, as described previously, after an image is printed on the front surface of a sheet P, the sheet P is turned over to perform duplex printing to print an image on the back surface of the sheet P, the sheet P is caused to expand or contract by the ink having been ejected onto the front surface of the sheet P. Thus, as shown in FIG. 9, even when the center position of the sheet P is determined based on one edge position of the sheet P in its width direction and the size information of the sheet P when printing an image on the front surface of the sheet P, the expansion or contraction of the sheet P causes the center position of the sheet P to deviate when printing an image on the back surface of the sheet P. As a result, the center positions of the images printed on the front and back surfaces of the sheet P also deviate from each other, which will make the sheet P look unattractive when on file or in bound form.

To prevent this inconvenience, in the present embodiment, when printing an image on the front surface (a first surface) of a sheet P, a dot (a reference marker) functioning as an image registration reference is printed, and based on the reference marker, registration is achieved between the image having been printed on the front surface and the image to be printed on the back surface (a second surface) of the sheet P.

Figure 10:
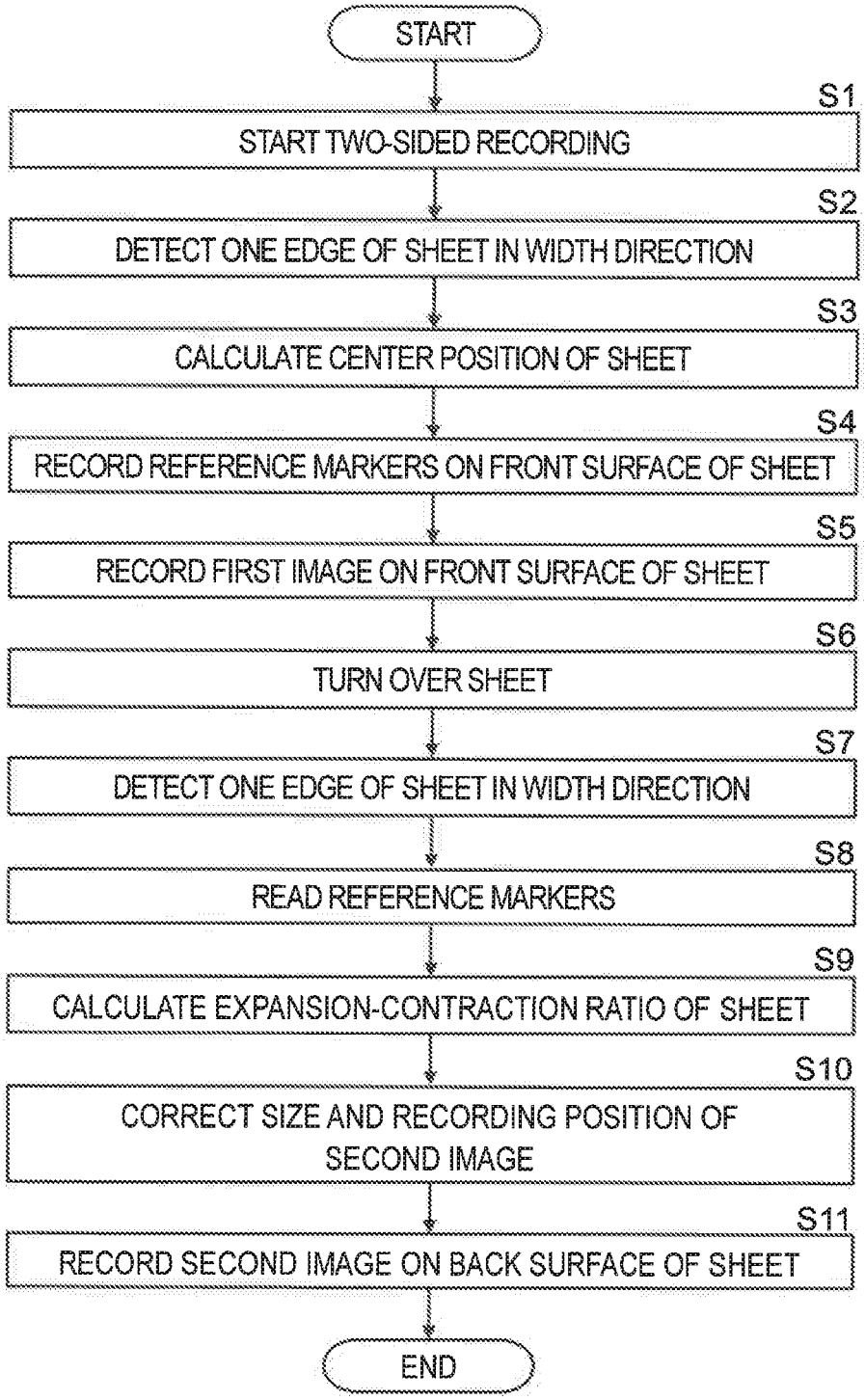
FIG. 10 is a flowchart showing an example of image registration control in duplex printing performed in the printer of the present embodiment.

FIG. 10 is a flowchart showing an example of image registration control in the duplex printing performed in the printer 100 of the present embodiment. Following the steps shown in FIG. 10, a description will be given of the process of registration between an image having been printed on the front surface of a sheet P and an image to be printed on the back surface of the sheet P, referring, as necessary, to FIG. 1 to FIG. 9, and also to FIG. 11 to FIG. 13 later.

When duplex printing is started in response to receipt of a printing instruction from an external device such as a personal computer (step S1), a sheet P is fed from the sheet feed cassette 2*a* or from the manual sheet feed tray 2*b*, and the CIS 60 detects one edge of the sheet P in its width direction from read data of the sheet P (step S2).

Next, the CPU 70 calculates the center position of the sheet P based on the above detected edge position and the size information of the sheet P (step S3). For example, in a case where the sheet P is of the A4 vertical size (210×297 mm), the center position is a position away from the edge position by a distance (=105 m) equivalent to ½ of the widthwise dimension (210 mm) of the sheet P.

Next, the CPU 70 prints a reference marker on the front surface of the sheet P with an ink ejection nozzle 18 corresponding to the calculated center position of the sheet P (step S4). Then, after printing the reference marker, the CPU 70 prints a first image (step S5). Steps S2 to S5 constitute a first process through which the first image is printed on a first surface of the sheet P as the printing surface.

Figure 11:
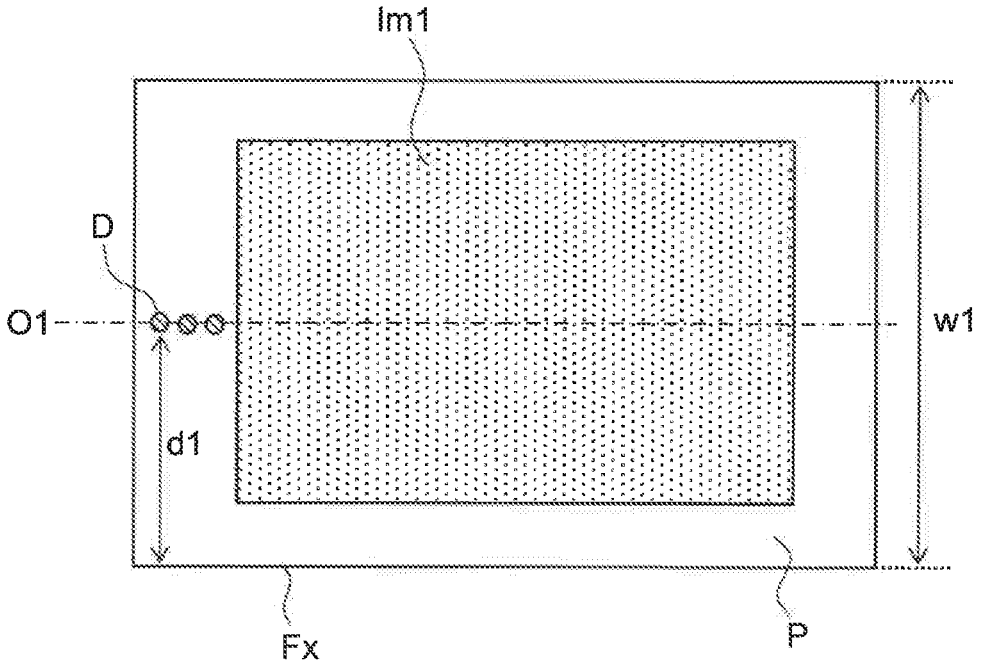
FIG. 11 is a plan view showing a state where a reference marker and a first image have been printed on a front surface of a sheet.

FIG. 11 is a plan view showing a state where a reference marker D and a first image lm1 has been printed on the front surface of the sheet P. As the reference marker D, a plurality of (here, three) reference markers D are printed along the sheet conveyance direction so as to overlap with the center position O1 of the sheet P having been calculated in step S3. Although just one reference marker D may be printed, to prevent erroneous detection of a dot resulting from undesired ejection of ink from the ink ejection nozzles 18 as the reference marker D, it is preferable to print a plurality of reference markers D along the sheet conveyance direction, at positions equidistant from the edge position Fx. The reference markers D are preferably printed in ink of a quiet color (the lightest one of the colors used) such as yellow. In a case where the first image Im1 is printed so as to overlap with the printing positions of the reference markers D, by providing pixels (dot omission) at which ink is not ejected within the first image Im1, the reference markers D can be formed as white reference markers D simultaneously with the printing of the first image Im1.

Further, the first image Im1 is also printed in registration with the center position O1 of the sheet P. Next, the sheet P is turned over by being conveyed form the second sheet conveyance passage 4*b* to the reverse conveyance passage 16 (step S6).

Figure 12:
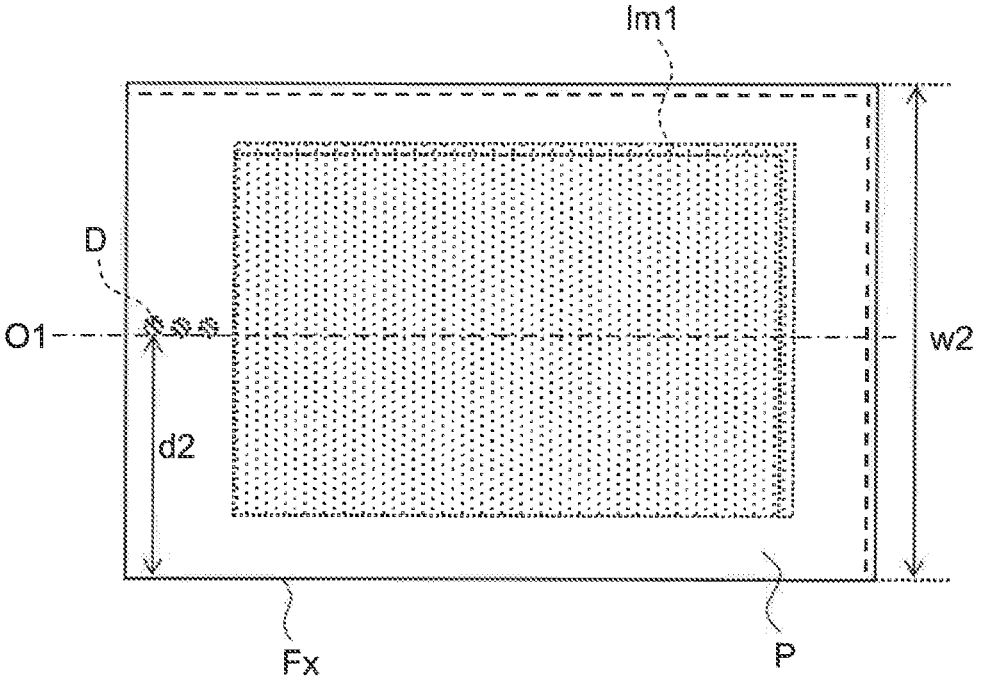
FIG. 12 is a plan view showing a state where the sheet has been turned over.

FIG. 12 is a plan view showing a state where the sheet P has been turned over. The sheet P is caused to expand by the ink ejected during the printing of the first image Im1, and thus the first image Im1 printed on the sheet P also expands. As a result, the center position of the first image Im1 and the reference markers D are deviated rearward (upward in FIG. 12) from the center position O1 of the sheet P with the front-side edge position Fx of the sheet P as the reference.

Next, detection of one edge of the sheet P in its width direction is performed by means of the CIS 60 (step S7), and also reading of the reference markers D is performed by means of the CIS 60 (step S8). Then, based on the edge position Fx of the sheet P and the positions of the reference markers D, the expansion-contraction ratio (correction magnification ratio) of the sheet P is calculated (step S9).

Specifically, the ratio is calculated between a distance d1 (see FIG. 11) from the edge position Fx to the reference markers D when the reference markers D are printed on the front surface of the sheet P and a distance d2 (see FIG. 12) from the edge position Fx to the reference markers D detected after the sheet P is turned over. For example, in a case where the sheet P is of the A4 vertical size, since d1=105 mm, the expansion-contraction ratio of the sheet P when d2=107 mm is 107/105≈1.019, and thus the expansion-contraction ratio is 101.96%.

Next, correction is performed of the size and the printing position of a second image to be printed on the back surface of the sheet P in its width direction (step S10). The size of the second image is corrected by using the expansion-contraction ratio of the sheet P having been calculated in step S9. In a case where the expansion-contraction ratio is 101.9%, the image is expanded by 1.019 as the correction magnification ratio. As to the printing position of the second image, the distance from the edge position Fx to the center position is corrected by multiplying the distance from the edge position Fx to the center position O1 by the expansion-contraction ratio of the sheet P, and the corrected center position is determined as the center position of the second image. Here, since 105×1.019=107 mm, the center position is corrected to a position that is 107 mm away from the edge position Fx. Then, by using the corrected size and printing position, the second image is printed on the back surface of the sheet P (step S11), and the process ends. The steps S6 to S11 constitute a second process through which the second image is printed on a second surface of the sheet P as the printing surface.

Figure 13:
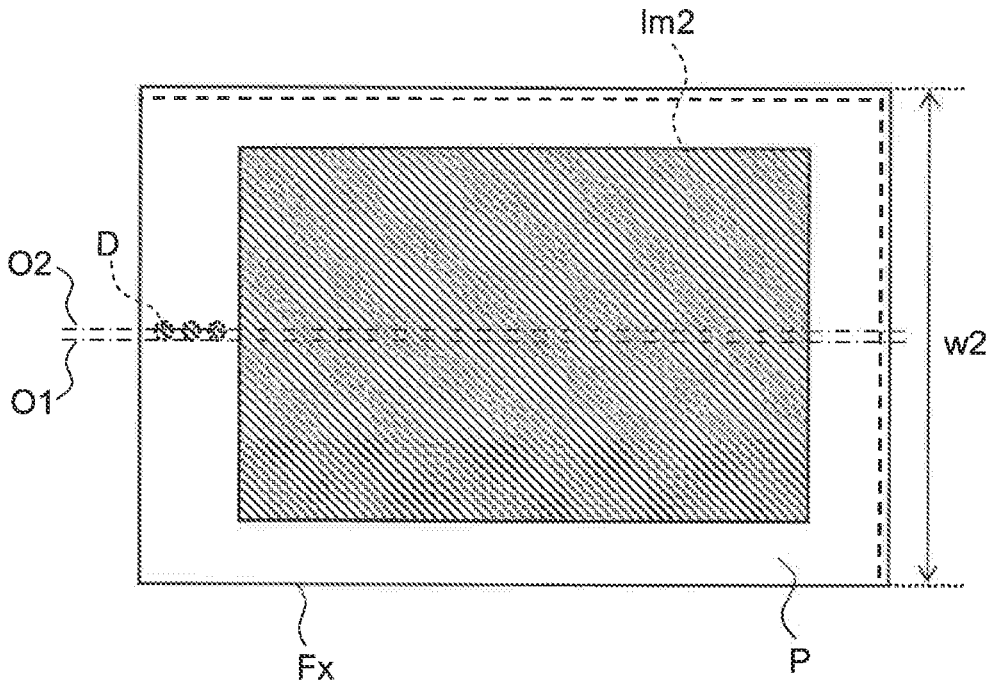
FIG. 13 is a plan view showing a state where a second image has been printed on the rear surface of the sheet.

FIG. 13 is a plan view showing a state where a second image Im2 has been printed on the back surface of the sheet P. As shown in FIG. 13, the second image Im2, in the size corrected in step S10, is printed such that its center coincides with a center position O2 corrected in step S10, and thus is in accurate registration with the first image Im1 (see FIG. 12) printed on the front surface.

With the above discussed control, in the case of performing duplex printing, regardless of the expansion or contraction of a sheet P resulting from the printing of the first image Im1 on the front surface of the sheet P, the first image Im1 and the second image Im2 printed on the back surface of the sheet P can be in accurate registration with each other. Further, since image registration is performed based on one edge position of a sheet P in its width direction and the size information of the sheet P, the CIS 60 can be smaller in width than a sheet P of the maximum acceptable size, which contributes to the reduction of the cost of the printer 100.

Here, in the above embodiment, the reference markers D are printed so as to overlap with the center position O1 of the sheet P, but the printing positions of the reference markers D are not restricted to the center position O1 of the sheet P, and can be printed at any position as long as the ratio d2/d1 can be calculated between the distance d1 (see FIG. 11) from the edge position Fx to the reference markers D and the distance d2 (see FIG. 12) from the edge position Fx to the reference markers D detected after the sheet P is turned over.

However, in a case where the distance d1 from the edge position Fx to the reference markers D is short, the difference between the distance d1 and the distance O2 after the expansion or contraction of the sheet P becomes small, which lowers the accuracy of the ratio d2/d1 calculated from d1 and d2. To prevent this, it is preferable to print the reference markers D at positions that are located between the center position O1 and the other edge position (edge position Rx) opposite from the edge position Fx which are within the effective detection region of the CIS 60.

The embodiment described above is in no way meant to limit the present disclosure, which thus allows for many modifications and variations within the spirit of the present disclosure. For example, although the above embodiment has dealt with an example where the CIS 60 is used as a sensor to detect the position of an edge of a sheet P, but a sensor other than a CIS, such as a CCD, may be used instead.

The number of the ink ejection nozzles 18, the nozzle interval, and the like of the recording heads 17 can be set appropriately in accordance with the specifications of the printer 100, Further, there is no particular restriction on the number of the recording heads 17, and, for example, two or more recording heads 17 may be arranged in each of the line heads 11C to 11*k*.

Further, although the image forming apparatus described in connection with the above embodiment is the printer 100 which is of the line head type, which performs printing by means of the recording heads 17 having a large number of ink ejection nozzles 18 arranged along the sheet width direction, the present disclosure is also applicable, exactly in the same manner, to a serial-type image forming apparatus, which performs printing with recording heads 17 scanning a sheet.

The present disclosure is usable in image forming apparatuses which perform printing by ejecting ink onto a sheet through ink ejection nozzles provided in a recording head. By using the present disclosure, it is possible to provide an image forming apparatus where accurate registration of images printed on the front and back surfaces of a sheet is achieved by detecting the position of only one edge of the sheet in its width direction.

What is claimed is:

1. An image forming apparatus comprising:

a sheet conveyance portion which conveys a sheet;

a recording portion which is arranged facing the sheet conveyance portion and ejects ink to a printing surface of the sheet conveyed by the sheet conveyance portion;

a sheet detection portion which is arranged on an upstream side of the recording portion with respect to a sheet conveyance direction, which is capable of reading a reading surface of the sheet which is opposite to the printing surface, and which detects an edge position of the sheet on one side of the sheet in a width direction intersecting the sheet conveyance direction; and a control portion which controls ink ejection from the recording portion and prints an image on the printing surface of the sheet, wherein, in a duplex printing including a first process through which a first image is printed on a first surface of the sheet as the printing surface and a second process through which the sheet is turned over and a second image is printed on a second surface of the sheet as the printing surface, in the first process, the control portion calculates a center position of the sheet based on the edge position of the sheet on the one side of the sheet in the width direction thereof having been detected by the sheet detection portion and size information of the sheet having been obtained in advance, prints the first image on the first surface such that the first image is centered on the center position calculated, and prints a reference marker at a predetermined printing position on the first surface, and, in the second process, the control portion reads the reference marker by means of the sheet detection portion, calculates a correction magnification ratio based on a difference between a reading position of the reference marker having been read and the printing position of the reference marker, and corrects a size of the second image and a printing position of the second image in the width direction using the correction magnification ratio.

2. The image forming apparatus according to claim 1, wherein the control portion calculates an expansion-contraction ratio of the sheet using a ratio d2/d1 between a distance d1 from the edge position to the reference marker in printing the reference marker on the first surface of the sheet and a distance d2 from the edge position detected after the sheet is turned over to the reference marker, and, determines a correction magnification ratio of the second image based on the expansion-contraction ratio of the sheet calculated.

3. The image forming apparatus according to claim 2, wherein the control portion corrects a distance from the edge position to the center position by multiplying a distance from the edge position on the one side to the center position of the sheet in the width direction thereof with the expansion-contraction ratio of the sheet, aligns the center of the second image whose size is corrected by the correction magnification with the corrected center position, and prints the second image on the second surface.

4. The image forming apparatus according to claim 1, wherein the reference marker is printed on the first surface, at a position between the center position and an edge position on other side of the sheet opposite from the one side in the width direction thereof.

5. The image forming apparatus according to claim 4, wherein, in a case where the first image is printed so as to overlap with the printing position of the reference marker, the reference marker is formed as a white reference marker by providing, in the first image, a pixel at which the ink is not ejected.

6. The image forming apparatus according to claim 1, wherein as the reference marker, a plurality of reference markers are printed along the sheet conveyance direction at positions equidistant from the edge position on the one side of the sheet in the width direction.

7. The image forming apparatus according to claim 1, wherein the reference marker is printed in the ink of a lightest color of all colors of the ink ejected in the recording portion.

* * * * *